United States Patent [19]

York

[11] Patent Number: 4,615,528

[45] Date of Patent: Oct. 7, 1986

[54] SOCCER TRAINING DEVICE

[76] Inventor: Henry A. York, 610 Range Rd., Palestine, Tex. 75801

[21] Appl. No.: 699,646

[22] Filed: Feb. 8, 1985

[51] Int. Cl.[4] ..... A63B 69/00

[52] U.S. Cl. ..... 273/396; 273/127 G; 273/411; 273/182 R

[58] Field of Search ..... 273/396, 395, 397, 411, 273/127 R, 127 C, 54 D, 47, 48, 182 R, 181 D, 180, 179 C

[56] References Cited

U.S. PATENT DOCUMENTS

| | | | |
|---|---|---|---|
| 965,591 | 7/1910 | Makray | 273/48 X |
| 1,658,097 | 2/1928 | Pierce | 273/395 |
| 2,899,208 | 8/1959 | Wallsteiner | 273/182 R |
| 2,994,968 | 8/1961 | Phillips | 273/54 D X |
| 3,420,528 | 1/1969 | Day | 273/182 R X |
| 4,083,561 | 4/1978 | Daffer, Jr. . | |
| 4,286,786 | 9/1981 | Papadopoulos . | |

FOREIGN PATENT DOCUMENTS

| | | | |
|---|---|---|---|
| 7900842 | 8/1980 | Netherlands | 273/395 |

*Primary Examiner*—Paul E. Shapiro
*Attorney, Agent, or Firm*—Sisson & Smith

[57] ABSTRACT

A soccer training device for guiding a soccer ball back to the approximate location from where it was kicked or thrown. The device comprises a frame, including an eave, and a net connected to the frame. The frame and net define a partially enclosed pocket wherein the ball is ultimately deflected by the eave and thereafter slowly guided back to the approximate location from where it was kicked or thrown. A brace supports the frame at an adjustable incline in order to roll the ball back to the practicing player and permit variable control of the return velocity of the ball.

22 Claims, 7 Drawing Figures

SOCCER TRAINING DEVICE

BACKGROUND OF THE INVENTION

The present invention relates to a device for guiding a soccer ball back to the approximate location from whence it was kicked or thrown.

Various apparatus have heretofore been employed in an effort to impede the forward motion of a kicked or thrown soccer ball and/or return the ball to the approximate location from whence it was kicked or thrown. For example, one end of a string or line has been attached to a ball with the other end of the string secured to a stake or other permanent object. The string prohibits the ball from traveling further than the length of the string and may actually cause the ball to be pulled backward in the general direction from whence it was kicked or thrown.

Backstops or practice nets have also been employed in an effort to impede the forward motion of a soccer ball and/or return the ball in the general direction from whence it was kicked or thrown. Although such devices may impede the forward motion of the ball, they are generally ineffective in guiding the ball back to the practicing player. For example, such backstops or practice nets typically cause the ball to spring or bounce outward at a speed which is only slightly less than the speed at which the ball initially struck the backstop or net. Further, the ball may not be returned or be deflected at an angle away from the direction from whence it was kicked or thrown by the practicing player.

Examples of such backstops or practice nets are illustrated in U.S. Pat. No. 4,083,561 issued to Daffer, Jr. and U.S. Pat. No. 4,286,786 issued to Papadopoulos. Daffer, Jr. discloses a soccer practice net having a forwardly sloping lower planar section and a discrete upper planar section sloping rearwardly at a distinct angle to the lower planar section. The practice net of Daffer, Jr. has a crossbar member located at the top thereof on the uppermost end of the upper planar section, thereby defining a completely open front. The open front design of the practice net disclosed in Daffer, Jr. allows the ball to initially strike the upper or lower planar sections and spring or bounce directly outward therefrom.

U.S. Pat. No. 4,286,786 issued to Papadopoulos discloses a soccer training goal which likewise has a completely open face or front. Papadopoulos discloses an inclined plate positioned at a distinct angle to a discrete rearward net. A cross member is located at the top of the goal on the uppermost end of the rearward net. Once again, however, the open face of the Papadopoulos device allows the soccer ball to initially strike and be immediately deflected outward by either the rearward net or inclined plate.

The apparatus disclosed in both Daffer, Jr. and Papadopoulos frequently permit or cause the soccer ball to be deflected away from the practicing player due to the open front and the fact that the ball may initially strike and be immediately deflected outward by any part of the net. Further, such a design frequently causes the ball to spring or bounce outward at only a slightly decreased speed from the speed at which it initially strikes the net. As a result, such apparatus do not provide the desired effectiveness in slowly guiding the soccer ball back to the approximate location from whence it was kicked or thrown.

SUMMARY OF THE INVENTION

Accordingly, the present invention provides a device for effectively guiding a soccer ball back to the approximate location from whence it was kicked or thrown. The device comprises a frame having a net connected thereto and a brace for supporting the frame at an incline.

The frame and net preferably define a partially enclosed pocket comprising a pair of side walls, a planar bottom, an arcuate back or rear wall integral with the bottom, and an arcuate overhang or eave integral with the rear wall. The forward, lowermost end of the arcuate eave terminates in a cross bar which overlays the bottom and is connected on each end thereof to the side walls. The intersection of the rear wall and eave defines the top of the enclosure and uppermost end of the eave and has a height relative to the frame base greater than the height of the cross bar.

During usage of the present device, the partial enclosure normally causes the kicked or thrown ball to initially strike or be received by the bottom. Due to its forward thrust, however, the ball will normally roll up, or be deflected up to, the rear wall. The ball will thereafter contact or be deflected by the eave and fall, or roll downward, to the bottom. Since the brace supports the bottom at an incline, gravity will cause the ball to thereafter roll downward along the bottom, outward from the pocket, and along the ground to the approximate location from whence it was kicked or thrown.

The design of the present apparatus, including the deflection of the ball by the eave, causes the kicked or thrown soccer ball to be rolled or guided back to the practicing player at a substantially reduced speed from the speed at which it was kicked or thrown. That is, the kicked or thrown ball will not spring or bounce back but will be gradually rolled back to the practicing player. The present invention thus provides a portable, soccer training device which overcomes the limitations inherent in the prior art.

DETAILED DESCRIPTION OF THE PREFERRED EMBODIMENT

Figure 1:
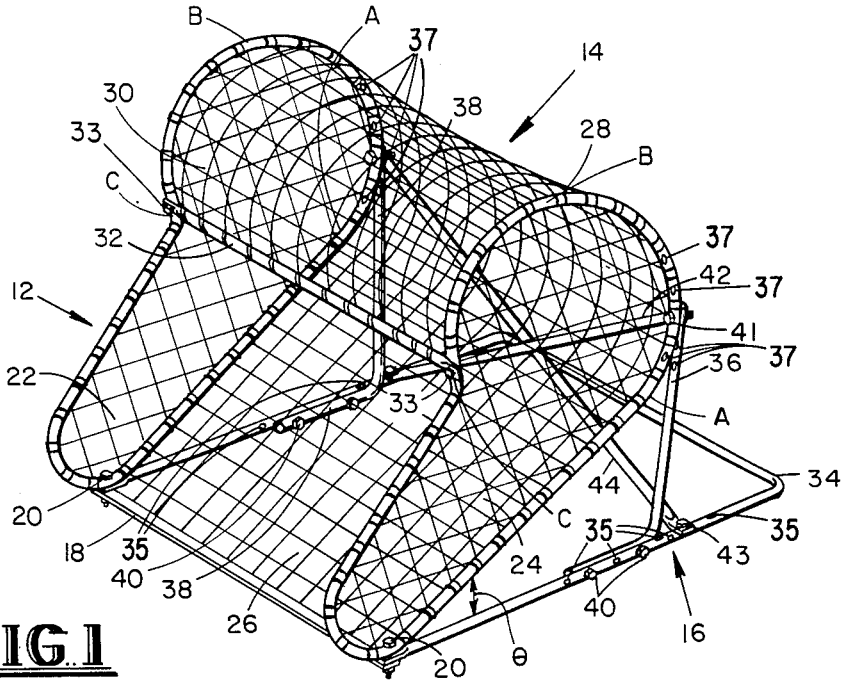
FIG. 1 is a perspective view of a preferred embodiment of a soccer training device.

The preferred embodiment of a soccer training device is illustrated in FIG. 1. The soccer training device comprises a frame 12 having a net 14 tied or otherwise appropriately connected thereto. Net 14 is preferably nylon fish netting or polyurethane netting but can be any type of resilient material capable of deflecting a kicked or thrown ball. The frame 12 is preferably supported by a brace 16 which is preferably connected to the frame 12 by bolts which extend through passages in the frame 12 and brace 16 and are secured thereto by nuts. Frame 12 preferably includes a lower cross member 18 which is connected on opposite ends thereof to frame 12 and brace 16 by bolts 20. Bolts 20 extend through passages in the frame 12, brace 16, and cross member 18 and are secured thereto by nuts.

Figure 2:
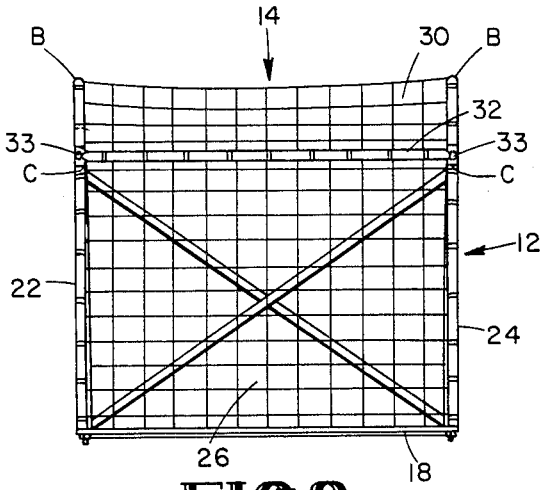
FIG. 2 is a frontal view of a preferred embodiment of a soccer training device.

Referring to FIG. 1 and FIG. 2, the frame 12 and net 14 define a partially enclosed pocket comprising a left side wall 22, a right side wall 24, a substantially planar bottom 26 intermediate side walls 22, 24, an arcuate back or rear wall 28, and an arcuate overhang or eave 30. The forward, lowermost end of eave 30 terminates in an upper cross member or bar 32 which is connected on opposite ends thereof to side walls 22 and 24 by bolts 33 which extend through passages in the cross bar 32 and frame 12 and are secured thereto by nuts.

Figure 3:
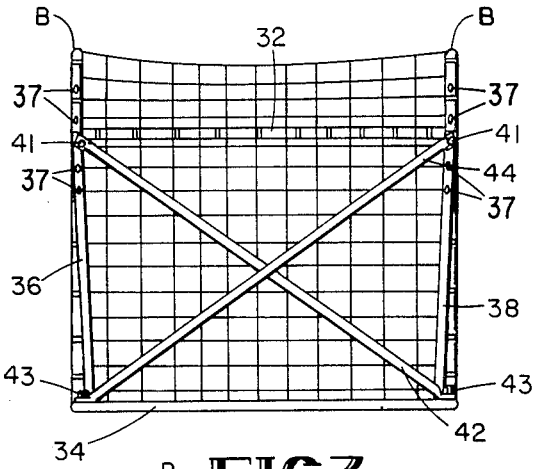
FIG. 3 is a rear view of a preferred embodiment of a soccer training device.

Referring to FIG. 1 and FIG. 3, the brace 16 comprises a horizontal base 34 which is connected to frame 12 and lower cross member 18 by bolts 20. Brace 16 also comprises a left and right L shaped vertical bar 36 and 38, respectively, which are connected on the lowermost ends thereof to base 34 by bolts 40 which extend through passages in base 34 and vertical bars 36 and 38, and are secured thereto by appropriate nuts. The brace 16 additionally comprises a pair of diagonal cross members 42 and 44 which are connected on the uppermost ends thereof to frame 12 and bars 36 and 38, respectively, by bolts 41 which extend through passages in frame 12, vertical bars 36, 38 and cross members 42, 44, and are secured thereto by nuts. Cross members 42 and 44 are connected on the lowermost ends thereof to base 34 by bolts 43 which extend through passages in base 34 and cross members 42, 44, and are secured thereto by nuts.

Figure 4:
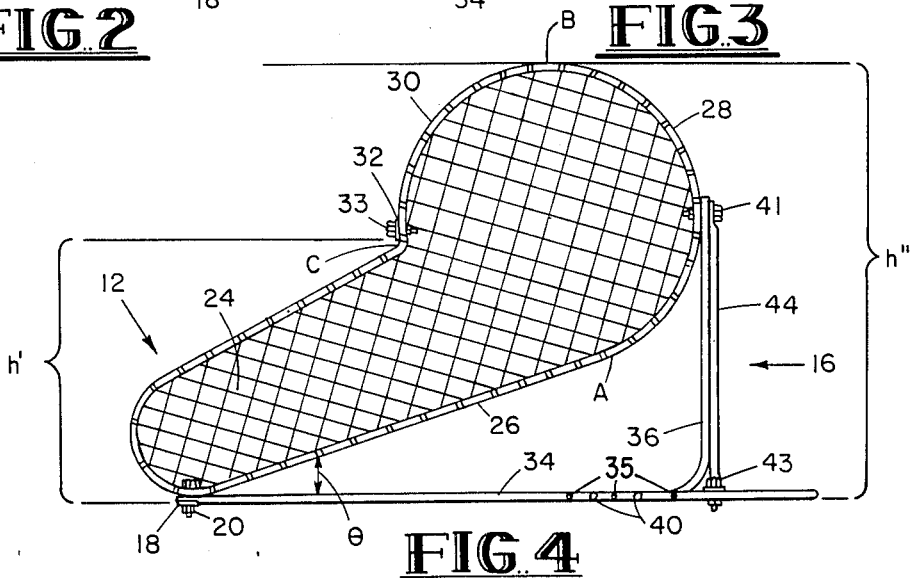
FIG. 4 is a side view of a preferred embodiment of a soccer training device.

Referring to FIG. 1 and FIG. 4, the preferred embodiment of the soccer training device is illustrated in greater detail. Point A identifies the intersection of planar bottom 26 with arcuate rear wall 28. Point B identifies the uppermost height or top of the soccer training device and the intersection of rear wall 28 with eave 30. Point B also identifies the uppermost end of eave 30 and the intersection of a horizontal line, parallel to base 34, with the top of frame 12, as illustrated in FIG. 4. Point C identifies the lowermost end of cross member 32 and the termination, or lowermost end, of eave 30.

In the preferred embodiment, rear wall 28 is integral with planar bottom 26 at point A and is defined as the arc segment between points A and B. Further, in the preferred embodiment, eave 30 is integral with rear wall 28 at point B and is defined as the arc segment between points B and C. Finally, in the preferred embodiment, rear wall 28 and eave 30 define a continuous curve or arc segment A-C of approximately two hundred and seventy degrees (270°) having a center point (not shown) equaldistant from points A, B, and C. Eave 30 preferably defines an arc segment of approximately ninety degrees (90°) and rear wall 28 preferably defines an arc segment of approximately one hundred and eighty degrees (180°).

Referring again to FIG. 4, it is seen that point C, and/or the lowermost end of cross member 32 and eave 30, preferably has a height h′ relative to horizontal base 34. Point B, and/or the top of the soccer training device and the uppermost end of eave 30, preferably has a height h″ relative to horizontal base 34. In the preferred embodiment, h″ will always be greater than h′. Eave 30 thereby partially encloses the pocket defined by frame 12 and net 14.

Referring to FIG. 1 and FIG. 4, it is seen that brace 16 supports frame 12, and particularly planar bottom 26, at an incline having an acute angle $\theta$ with respect to the horizontal base 34. It is to be understood that the soccer training device may be designed to permit the adjustment of angle $\theta$ to permit any incline from zero to ninety degrees. This can be readily done by permitting the variable positioning of the lowermost ends of bars 36 and 38, and cross members 42 and 44, along base 34. That is, additional passages 35 can be provided along the length of base 34 to permit the insertion and securement of bolts 40 and 43 along the length of base 34. Additionally, the soccer training device may be designed to permit the variable connection of the uppermost ends of bars 36 and 38 and cross members 42 and 44, respectively, to frame 12. That is, additional passages 37 can be provided through the uppermost ends of bars 36, 38 and/or frame 12 along rear wall 28 to permit the insertion and securement of bolts 41 along rear wall 28. Bolts 20 can also be loosened or tightened in accordance with the incline defined by angle $\theta$.

Figure 5:
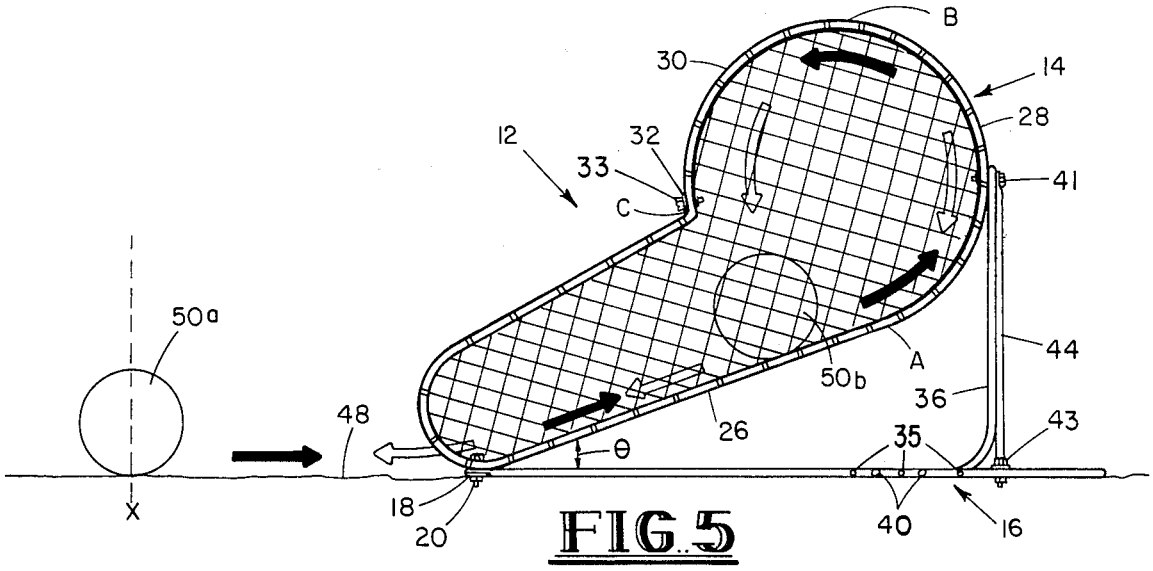
FIG. 5–FIG. 7 are side views illustrating alternate paths of movement of a ball interacting with a preferred embodiment of a soccer training device.
Figure 6:
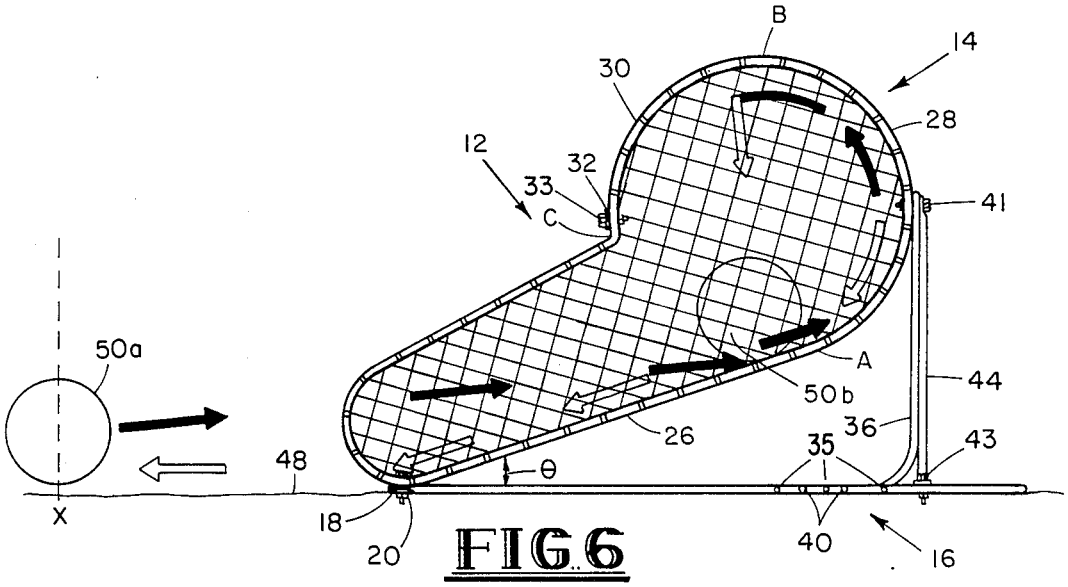
Figure 7:
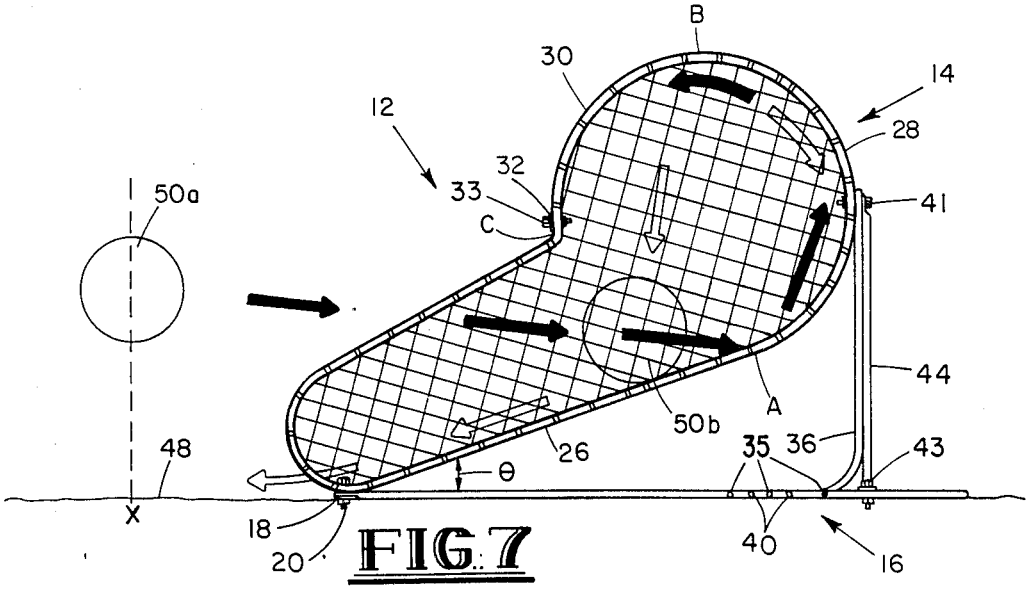

Referrring to FIG. 5–FIG. 7, the soccer training device is illustrated in a horizontal position on the ground 48. The frame 12 and bottom 26 are supported at an incline $\theta$ by brace 16. The soccer training device is illustrated receiving a soccer ball 50, which has been kicked or thrown from approximately point "X", and guiding the ball 50 in approximately a straight line back to the approximate location from whence it was kicked or thrown (point "X"). It is to be understood that point "X" is the position of the practicing player and is located a certain distance away from, and in front of, the soccer training device. The shaded arrows in FIGS. 5–7 illustrate the approximate path(s) of the kicked or thrown ball **50*a* as it enters the partially enclosed pocket defined by the frame 12 and net 14. The clear arrows illustrate the approximate path(s) of the deflected ball 50*b* as it exits the soccer training device pocket. FIGS. 5–7, as described more fully hereinbelow, illustrate three examples of the possible interaction of the ball 50** with the soccer training device.

Referring to FIG. 5, the ball **50*a* is illustrated rolling along the ground 48 from point "X" and upward into the pocket of the soccer training device along planar bottom 26, as illustrated by the shaded arrows. Due to the fact that planar bottom 26 is preferably integral with arcuate rear wall 28, and assuming ball 50*a* has sufficient forward velocity or thrust, ball 50*a* will roll up to and slightly past point B. When the ball 50*a* passes point B, ball 50*a* will contact, or be deflected by, arcuate eave 30. Ball 50*b* will thereafter either fall downward onto planar bottom 26 or roll downward along the arc of rear wall 28 back onto bottom 26, as illustrated by the clear arrows in FIG. 5. In either event, gravity will cause ball 50*b* to roll down inclined planar bottom 26 and along ground 48** back to the approximate location from whence it was kicked or thrown.

Referring to FIG. 6, the ball **50*a* is illustrated in flight from approximately point "X" and initially striking planar bottom 26 with a generally forward and upward velocity or thrust, as illustrated by the shaded arrows. After the ball 50*a* strikes planar bottom 26 it will thereafter roll, or be deflected, upward to rear wall 28. At that point, the ball 50*a* will either roll, or be deflected, upward to eave 30. Once ball 50*a* contacts, or is deflected by, eave 30, it will thereafter fall downward to planar bottom 26, or simply roll back down rear wall 28 to bottom 26**, as illustrated by the clear arrows in FIG.

6. In either event, gravity will cause the ball 50*b* to roll down inclined bottom 26 and along the ground 48 back to the approximate location from whence it was kicked or thrown.

Referrring to FIG. 7, the ball 50*a* is illustrated in flight from approximately point "X" with a generally forward and downward velocity or thrust, as illustrated by the shaded arrows. The ball 50*a* initially strikes the bottom 26 and is thereafter deflected upward to eave 30 or rear wall 28 and eave 30. When the ball 50*a* contacts, or is deflected by, eave 30, it will either roll down to bottom 26 along the arc of rear wall 28 or simply fall back down to bottom 26, as illustrated by the clear arrows in FIG. 7. In either event, gravity will cause the ball 50*b* to roll down inclined bottom 26 and along ground 48 back to the approximate location from whence it was kicked or thrown.

It is to be understood that normally the ball 50 will initially strike planar bottom 26 upon entering the partially enclosed pocket of the soccer training device. However, the ball 50 may also strike side walls 22 or 24 upon entering the pocket. In either event, assuming it has sufficient velocity, ball 50 will almost always be deflected by eave 30 as it travels upward along arc A-C and ultimately roll outward along bottom 26 and back to the practicing player in approximately a straight line. Eave 30 thus generally prohibits the ball 50 from initially striking rear wall 28 upon entering the soccer training device.

It is to be understood that the overhang 30, terminating in upper cross member 32, thus serves the dual purpose of contacting and/or deflecting the ball 50 so as to cause the ball 50 to roll down planar bottom 26 prior to exiting the soccer training device. Additionally, the curve of arc A-C, deflection of ball 50 by eave 30, and/or resultant roll of the ball 50 down planar bottom 26, causes the ball 50 to be returned to the practicing player at a velocity which is substantially less than the velocity with which the ball 50 initially entered the soccer training device. Finally, the adjustment of the incline $\theta$ of planar bottom 26, as previously described, allows for some variation and/or control over the velocity with which the ball 50 is guided back to the practicing player. Finally, it is to be understood that frame 12 may include, or be integral with, brace 16.

In the preferred embodiment, frame 12 and brace 16 are constructed of galvanized conduit or aluminum tubing which is bolted together or otherwise connected as shown in FIG. 1, and lower cross member 18 is a flat piece of metal. The soccer training device is preferably lightweight, portable, and preferably has a width between side walls 22 and 24 of approximately forty-eight inches (48"). The soccer training device preferably has a length from the forward end of base 34 to the rear of base 34 of approximately fifty-nine inches (59"). Vertical bars 36, 38 preferably have a height of approximately twenty-eight inches (28"). Arc segment A-C preferably has a diameter of approximately twenty-eight inches (28"). The height of h' is preferably approximately thirty-one inches (31") and the height of h" is preferably approximately forty-four inches (44"). Finally, it is to be understood that point B will preferably have a height relative to bottom 26 greater than the height of point C relative to bottom 26.

It is also to be understood that the left and right ends of bottom 26, rear wall 28, and eave 30 form a part of side walls 22 and 24, respectively. Further, an arc segment A-C can be defined at any point along the width of rear wall 28 and eave 30 from left side wall 22 to right side wall 24. That is, point A identifies the intersection of bottom 26 with rear wall 28 at any point along the width of bottom 26, point B identifies the intersection of rear wall 28 with eave 30 at any point along the width of rear wall 28, and point C identifies the lowermost end of eave 30 at any point along the width of eave 30, from side wall 22 to side wall 24.

While the soccer training device has been described in connection with the preferred embodiment, it is not intended to limit the invention to the particular form set forth, but on the contrary, it is intended to cover such alternatives, modifications, and equivalents, as may be included within the spirit and scope of the invention as defined by the appended claims.

I claim:

1. A soccer training device, comprising:

a frame;

means for supporting said frame, said frame support means including a horizontal base; and means connected to said frame for deflecting a kicked or thrown ball, said frame and ball deflection means defining a partially enclosed pocket comprising a pair of opposed side walls, a bottom intermediate said side walls, a rear wall, and an eave, said eave terminating in a cross member, a top of said frame having a height relative to said horizontal base greater than a height of said cross member relative to said horizontal base, said pocket shaped so as to permit said ball to return to said bottom after contacting an inside of said eave.

2. A soccer training device, as recited in claim 1, wherein said eave is arcuate.

3. A soccer training device, as recited in claim 1, wherein said frame support means supports said bottom at an incline.

4. A soccer training device, as recited in claim 1, wherein said rear wall and eave define an arc segment of approximately two hundred and seventy degrees.

5. A soccer training device, as recited in claim 1, wherein said means for deflecting a kicked or thrown ball comprises a net connected to said frame.

6. A soccer training device, as recited in claim 5, wherein said net is nylon fish netting.

7. A soccer training device, as recited in claim 5, wherein said net is polyurethane netting.

8. A soccer training device, as recited in claim 1, wherein said frame support means comprises a brace constructed of galvanized conduit tubing and said brace is bolted to said frame.

9. A soccer training device, as recited in claim 1, wherein said bottom is planar.

10. A soccer training device comprising:

a frame;

means for supporting said frame, said frame support means including a horizontal base; and means connected to aid frame for deflecting a kicked or thrown ball, said frame and ball deflection means defining a partially enclosed pocket comprising a pair of opposed side walls, a bottom intermediate said side walls, a rear wall integral with said bottom, and an eave integral with said rear wall, said eave terminating in a cross member, a top of said frame having a height relative to said horizontal base greater than a height of said cross member relative to said horizontal base, wherein said frame support means supports said bottom at an incline and further comprising means for adjusting said frame support means thereby to adjust said incline of said bottom.

11. A soccer training device comprising:

a frame;

a brace for supporting said frame at an incline, said brace including a horizontal base; and a net connected to said frame for deflecting a kicked or thrown ball, said frame and net defining a partially enclosed pocket comprising a pair of opposed side walls, a planar bottom intermediate said side walls, an arcuate rear wall integral with said bottom, and an arcuate eave integral with said rear wall, said rear wall and eave defining a continuous arc segment of approximately two hundred and seventy degrees, said eave terminating in a cross member, a top of said frame having a height relative to said horizontal base greater than a height of said cross member relative to said horizontal base, said pocket shaped so as to permit said ball to return to said bottom after contacting an inside of said eave.

12. A soccer training device comprising:

a frame;

a brace for supporting said frame at an incline, said brace including a horizontal base, further comprising means for adjusting said brace, thereby to adjust said incline of said frame; and a net connected to said frame for deflecting a kicked or thrown ball, said frame and net defining a partially enclosed pocket comprising a pair of opposed side walls, a planar bottom intermediate said side walls, an arcuate rear wall integral with said bottom, and an arcuate eave integral with said rear wall, said rear wall and eave defining a continuous arc segment of approximately two hundred and seventy degrees, said eave terminating in a cross member, a top of said frame having a height relative to said horizontal base greater than a height of said cross member relative to said horizontal base.

13. A soccer training device, comprising:

a frame; and means connected to said frame for deflecting a kicked or thrown ball, said frame and ball deflection means defining a partially enclosed pocket comprising a plurality of walls, a bottom, and an eave, said eave having an uppermost end and a lowermost end, said uppermost end of said eave having a height relative to a base of said frame greater than a height of said lowermost end of said eave relative to said frame base, said pocket shaped so as to permit said ball to return to said bottom after contacting an inside of said eave.

14. A soccer training device, as recited in claim 13, wherein one of said walls comprises a rear wall, and said rear wall is integral with said bottom and said eave is integral with said rear wall.

15. A soccer training device, as recited in claim 14, wherein said rear wall and eave define a continuous curve of approximately two hundred and seventy degrees.

16. A soccer training device, as recited in claim 13, wherein said means for deflecting said ball comprises a net connected to said frame.

17. A soccer training device, as recited in claim 13, wherein one of said walls comprises a rear wall, and said rear wall is arcuate.

18. A soccer training device, as recited in claim 13, wherein said eave is arcuate.

19. A soccer training device, as recited in claim 13, wherein said bottom is at an incline.

20. A soccer training device, as recited in claim 13, wherein said bottom is substantially planar.

21. A soccer training device, comprising:

a frame;

means for supporting said frame, said frame support means including a horizontal base; and means connected to said frame for deflecting a kicked or thrown ball, said frame and ball deflection means defining a partially enclosed pocket comprising a pair of side walls, a bottom, a rear wall, and an eave, said eave terminating in a cross member, a top of said frame having a height relative to said horizontal base greater than a height of said cross member relative to said horizontal base, said pocket shaped so as to permit said ball to return to said bottom after contacting an inside of said cave, said cross member being substantially parallel to said bottom.

22. A soccer training device, comprising:

a frame; and means connected to said frame for deflecting a kicked or thrown ball, said frame and ball deflection means defining a partially enclosed pocket comprising a plurality of walls, a bottom, and an eave, said eave having an uppermost end and a lowermost end, said uppermost end of said eave having a height relative to a base of said frame greater than a height of said lowermost end of said eave relative to said frame base, said pocket shaped so as to permit said ball to return to said bottom after contacting an inside of said eave, said lowermost end of said eave being substantially parallel to said bottom.

* * * * *